US006260467B1

(12) United States Patent
Mickelson et al.

(10) Patent No.: US 6,260,467 B1
(45) Date of Patent: Jul. 17, 2001

(54) HYDRAULIC CIRCUIT PROVIDING PLURAL SWING RATES IN AN EARTHWORKING CONSTRUCTION MACHINE

(75) Inventors: Roger Mickelson, West Burlington; Richard J. Lech, Burlington, both of IA (US)

(73) Assignee: Case Corporation, Racine, WI (US)

( * ) Notice: Subject to any disclaimer, the term of this patent is extended or adjusted under 35 U.S.C. 154(b) by 0 days.

(21) Appl. No.: 09/404,183

(22) Filed: Sep. 24, 1999

(51) Int. Cl.[7] ..... F15B 13/04
(52) U.S. Cl. ..... 91/31; 91/32; 91/33; 91/443
(58) Field of Search ..... 91/31, 32, 33, 91/443

(56) References Cited

U.S. PATENT DOCUMENTS

| | | | | |
|---|---|---|---|---|
| 3,922,855 | | 12/1975 | Bridwell et al. . | |
| 3,978,998 | | 9/1976 | Klitz . | |
| 4,015,729 | | 4/1977 | Parquet et al. . | |
| 4,030,623 | | 6/1977 | Bridwell et al. . | |
| 4,163,628 | | 8/1979 | Hall et al. . | |
| 4,215,844 | * | 8/1980 | Bowen | 91/31 X |
| 4,429,619 | * | 2/1984 | Leutner et al. | 91/31 X |
| 4,473,090 | * | 9/1984 | Uehara et al. | 91/31 X |
| 4,838,756 | | 6/1989 | Johnson et al. . | |
| 5,123,509 | * | 6/1992 | Wolf et al. | 91/31 X |
| 5,493,798 | | 2/1996 | Rocke et al. . | |
| 5,629,849 | | 5/1997 | Ahn . | |

* cited by examiner

*Primary Examiner*—Hoang Nguyen
(74) *Attorney, Agent, or Firm*—Jansson, Shupe & Munger, Ltd.

(57) ABSTRACT

A construction machine, e.g., a backhoe, has a chassis and a digging tool mounted for movement, e.g., swinging movement, with respect to such chassis. A machine hydraulic circuit includes a pump, a hydraulic actuator coupled to the tool for tool movement, and a directional valve between the pump and the actuator. In several specific embodiments, the circuit includes first and second flow restrictors coupled between the pump and the actuator. There is also a valve device for selectively disabling the second flow restrictor, thereby configuring the circuit to provide either of two maximum rates of tool movement. In other embodiments, the circuit uses a variable delivery, fluid-pumping power source and a load-sensing line coupled between the pump and the actuator. The valve device is in series with the load-sensing line and includes a restriction-free path and a flow-restricted path therethrough, thereby configuring the circuit to provide either of two maximum rates of tool movement.

21 Claims, 7 Drawing Sheets

HYDRAULIC CIRCUIT PROVIDING PLURAL SWING RATES IN AN EARTHWORKING CONSTRUCTION MACHINE

FIELD OF THE INVENTION

This invention relates generally to earth working and, more particularly, to earthworking vehicles of the type having a digging tool actuated by an independent power unit. A backhoe, a type of construction machine, is an example.

BACKGROUND OF THE INVENTION

Construction machines are called upon to perform a wide variety of tasks. A good example of such a machine is known as a backhoe and has a chassis which is often mounted on rubber-tired wheels, at least two of which are steerable. An operator's cab is supported by the chassis and the controls for the machine, e.g., the handles of hydraulic valves and the like, are mounted in such cab.

An articulated digging tool (which bears a resemblance to a human arm and hand) has one end of a boom mounted to the chassis for both "up-down" pivoting movement about a horizontal axis and rotating or "swing" movement about a vertical axis. The other end of the boom is hinge-connected to one end of a stick while a digging bucket is hinge-connected to the other end of the stick. The motion of the bucket with respect to its supporting stick is sometimes descriptively referred to as "curl."

In a backhoe, the bucket and its digging teeth face toward the chassis and the operator. Digging is achieved by urging the bucket teeth into the earth and moving the bucket toward the operator. When the bucket is filled, the operator "curls" it toward the stick and boom, raises it above ground level, swings the bucket to one side and, by curling in the opposite direction, empties its contents onto a pile or the like. As described below, digging and swing power are provided by hydraulic actuators. A hydraulic system for a backhoe-type excavator is disclosed in U.S. Pat. No. 4,838,756 (Johnson et al.).

Hydraulic actuators, e.g., rotary and linear motors (the latter usually called hydraulic cylinders) are separately controllable by the operator and separately power the swing movement, the up-down movement of the boom with respect to the chassis, the movement of the stick with respect to the boom and the movement of the digging bucket with respect to the stick. Motive power for the actuators is furnished by one or more hydraulic pumps drawing liquid, e.g., hydraulic oil, from a reservoir and delivering such liquid under pressure through a directional valve to a particular actuator or to particular actuators, in accordance with how the operator manipulates the controls.

If a backhoe is digging a trench in an open field, a high, maximum rate of swing is preferred for reasons related to machine "cycle time." The digging rate (and, therefore, productivity) are thereby improved.

On the other hand, if a backhoe is or is likely to be digging around or near a building foundation or wall or the like, it is desirable to limit the available swing rate to less than the maximum rate available for that particular machine configuration. In that way, the possibility of damaging the foundation or wall is greatly reduced.

The directional valve used by the operator to control swing rate is usually configured so that it can be "metered" or "feathered." That is, the rate of swing is a function of the position of the valve handle; moving the handle from its neutral to maximum offset position provides a continuum of swing rates from zero to the maximum available rate.

For an experienced machine operator, manipulation of the control handles and functions of a backhoe tend to be rather habitual, intuitive and "rhythmic." For that reason, neither the operator nor others prefer to rely upon the operator's skill and perception to, somewhat unusually, limit swing rate when working, e.g., near a building.

A known way to limit swing rate is run the engine and pump at wide open throttle and use an inlet restrictor, e.g., an orifice, between the pump and the inlet to the directional valve controlling the swing function. Under those operating conditions, the pump will deliver more hydraulic fluid than the orifice will accept. The remainder is "dumped" over a relief valve or the like. This approach results in a subtle but undesirable operating characteristic.

While the use of an inlet orifice in the foregoing manner will limit swing rate, it has no effect on the operating rates of the other functions, e.g., boom and stick extend or retract, bucket "curl," and the like. To state it another way, the maximum swing rate is, to an experienced operator accustomed to that machine, disproportionately low as compared to the maximum rates of the other functions. To the operator, the rhythm and intuition of operation are lost and productivity suffers.

An example will illuminate the foregoing. It is assumed that the hydraulic pump on a backhoe is capable of providing 25 gallons/minute (about 95 liters/minute) at a wide-open-throttle engine speed of 2300 rpm and of providing about 18 gallons/minute (about 68 liters/minute) at 1800 rpm engine speed. If swing rate is limited by reducing engine speed from 2300 rpm to 1800 rpm (which calculates to a reduction multiplier of 1800 divided by 2300 or about 0.72), the maximum rate of all of the other machine functions will also be reduced to 0.72 of their rates at higher engine speed. Rate "proportionality" is retained.

On the other hand, if engine speed is maintained at 2300 rpm and swing rate is reduced by using an inlet orifice as described above (and assuming the orifice will accept 18 gallons/minute maximum), the swing rate is reduced to 0.72 of its normal value. However, the rates of all of the other functions are maintained at their maximum rates at 2300 rpm engine speed. Function rate "proportionality" is lost.

The patent literature discloses a number of arrangements for controlling the operating speed of various functions in a construction or earthworking machine. For example, U.S. Pat. No. 4,838,756 (Johnson et al.) discloses an excavator hydraulic system having a pair of variable displacement pumps controlled by pilot operated load sensing control valves. There is a provision for placing one of the pumps in standby condition to reduce system flow capacity. U.S. Pat. No. 4,015,729 (Parquet et al.) discloses an automatic control system that controls pivot rate in a backhoe.

It is to be appreciated that another type of construction machine, known as an excavator, is closely similar in operation and configuration to a backhoe. A difference is that in an excavator, the bucket and its digging teeth face away from the chassis and the operator and digging is achieved by urging the bucket teeth into the earth in a direction away from the operator. But irrespective of this difference, control of swing rate control can also be important.

A hydraulic circuit and method which respond to the needs of the industry would be an important technological development.

OBJECTS OF THE INVENTION

It is an object of the invention to provide an improved hydraulic circuit and method which provide a plural swing rates in a construction machine.

Another object of the invention is to provide hydraulic circuit and method with improved control for delicate situations.

Another object of the invention is to provide an improved hydraulic circuit and method which permit obtaining high engine horsepower.

Yet another object of the invention is to provide hydraulic circuit and method which improve machine productivity. How these and other objects are accomplished will become apparent from the following descriptions and from the drawings.

SUMMARY OF THE INVENTION

The invention involves a hydraulic circuit for a construction machine having a chassis and a digging tool mounted for movement with respect to the chassis. The circuit is disclosed in connection with a backhoe, its bucket and swinging movement of such bucket and its supporting boom and stick. The circuit includes a hydraulic pump, a hydraulic actuator (e.g., one or two hydraulic motors) coupled to the tool for tool movement, and a directional valve coupled between the pump and the actuator for controlling the direction of tool movement.

The circuit improvement comprises first and second flow restrictors coupled between the pump and the actuator. Preferably, such restrictors are connected in parallel with one another and a valve device is connected to the second flow restrictor for selectively disabling such restrictor. The circuit is thereby configured to provide either of two maximum rates of tool movement.

The first and second flow restrictors are coupled between the pump and the directional valve. In one, more specific embodiment, the circuit includes a load check or check valve connected to both flow restrictors. In a second embodiment, the circuit includes first and second check valves connected to the first and second flow restrictors, respectively. In such second embodiment, the first and second check valves are connected in series with the first and second flow restrictors, respectively.

The valve device may assume one of two or more possible configurations. In the preferred embodiment, the valve device is a two-position, two-way solenoid valve. Using a solenoid valve permits such valve to be mounted remotely from the operator's cab (which is likely to be more convenient from a hydraulic plumbing standpoint) and the valve position controlled by an electric switch or the like. But the valve device may also be a two-position, two-way manually operated valve.

In other aspects of the invention, the circuit includes a reservoir and the directional valve includes a power flow path from the pump to the actuator and a return flow path from the actuator to the reservoir. The first flow restrictor is in the power flow path, irrespective of whether the second flow restrictor is disabled. The valve device is configured for movement between a first position and a second position and the second flow restrictor is in the power flow path when the valve device is in the first position. And such second flow restrictor is disconnected from the power path when the valve device is in the second position.

Other versions of the hydraulic circuit include a variable-delivery power source. Such power source may include a pressure-controlled, variable-delivery pump or it may include a fixed displacement pump fitted with a load sensing unloading valve. There is a load-sensing line coupled between the power source and the actuator for sensing the differential pressure therebetween.

A valve device is connected in the circuit and is configured for movement between first and second pressure-drop positions. The circuit is thereby configured to provide either of two maximum rates of tool movement. In one, more-specific version of those circuits using a variable-delivery power source, the valve device is connected to the supply line running from the power source to the actuator. In another such version, the valve device is connected to the load-sensing line.

Other aspects of the invention involve a method for controlling the maximum swing rate of a digging tool mounted for swing movement on a chassis of a construction machine. In those embodiments of the circuit which are of the open circuit type, the method includes providing a hydraulic cylinder coupled to the digging tool for tool swinging movement and providing a hydraulic circuit including a reservoir and a pump connected to the reservoir and powering the cylinder. The circuit includes a directional valve connected between the pump and the cylinder. There is a power flow path from the pump to the cylinder through the valve and a return flow path from the cylinder to the reservoir through the valve.

A first flow restrictor is in the power flow path and a restriction circuit is connected in parallel with the power flow path. Such restriction circuit has open and closed flow states.

In one mode of operation, fluid is delivered from the pump along the power flow path to the cylinder while the restriction circuit is in the closed or flow-preventing state, thereby obtaining a first, lower swing rate. In another mode of operation, fluid is delivered from the pump along the power flow path to the cylinder while the restriction circuit is in the open or flow-permitting state, thereby obtaining a second, higher swing rate.

In more specific aspects of the new method, the power flow path includes a first flow restrictor in series therewith. Both delivering steps include flowing fluid through the first flow restrictor. Where the restriction circuit includes a second flow restrictor in series with a valve device, the second delivering step includes delivering fluid from the pump through the second flow restrictor.

When the valve device is embodied as a solenoid valve, the method includes the step of opening the solenoid valve. Such opening step occurs after the first delivery step and preceding the second delivery step. When the valve device is embodied as a manually operated valve, the method includes the step of opening the manually operated valve. As noted above, such opening step occurs after the first delivery step and preceding the second delivery step.

In those embodiments of the circuit which are of the closed center type using a variable-delivery power source, the method includes providing a hydraulic cylinder coupled to the digging tool for swinging movement thereof. A hydraulic circuit is provided and includes (a) a reservoir, (b) the variable-output hydraulic power source connected to the reservoir and powering the cylinder, (c) a directional valve connected between the power source and the cylinder and including a power flow path from such source to the cylinder and a return flow path from the cylinder to the reservoir, and (d) a load-sensing line coupled between the power source and the hydraulic cylinder.

A valve device is provided and is coupled in flow-affecting relationship in the circuit. Such valve device is configured for movement between first and second positions. Fluid is delivered from the pump along the power flow path to the cylinder while the device is in the first position, thereby obtaining a first swing rate. And fluid is delivered from the pump along the power flow path to the cylinder while the device is in the second position, thereby obtaining a second swing rate.

In a more specific aspect, the valve device is connected to the power flow path and, following the first delivering step and preceding the second delivering step, the method includes the step of shifting the valve device from the first position to the second position. In another, more specific aspect involving another embodiment, the valve device is connected to the load-sensing line. Following the first delivering step and preceding the second delivering step, the method includes the step of shifting the valve device from the first position to the second position.

Further details of the invention are set forth in the following detailed descriptions and in the drawings.

DETAILED DESCRIPTIONS OF PREFERRED EMBODIMENTS

Figure 1:
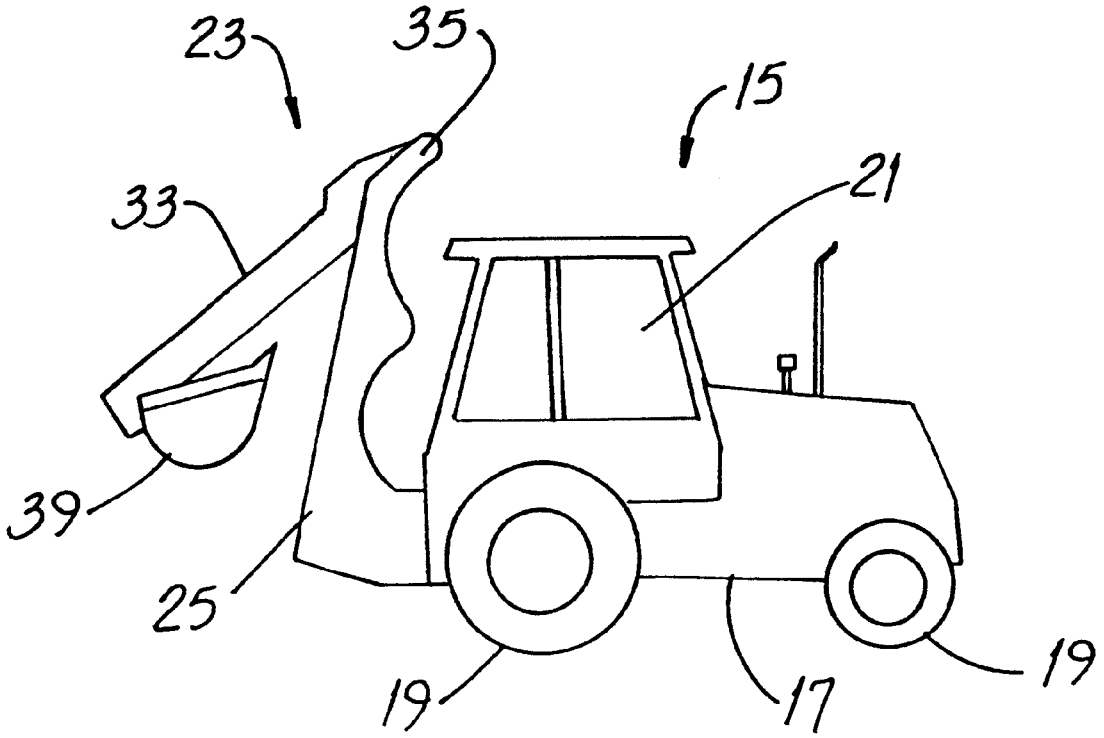
FIG. 1 PRIOR ART
FIG. 1 is a representative side elevation view of an exemplary construction machine, i.e., a backhoe.
Figure 2:
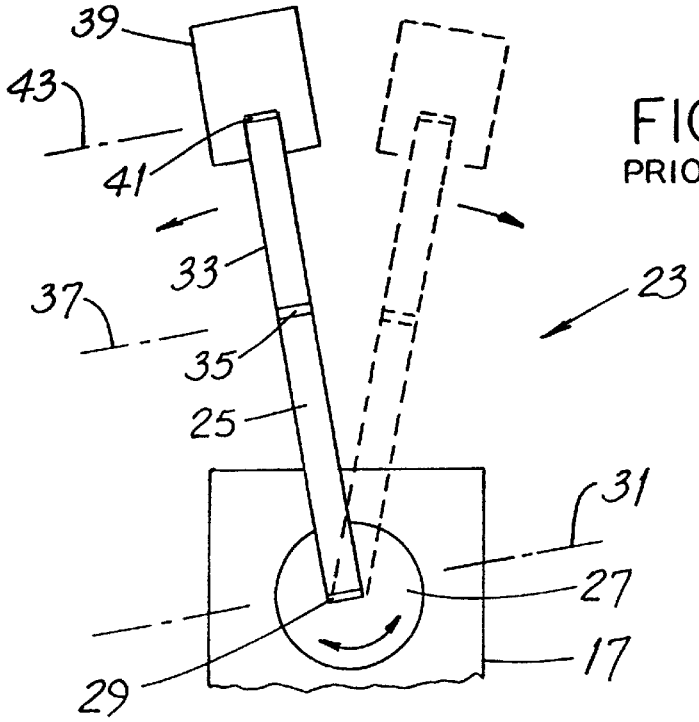
FIG. 2 PRIOR ART
FIG. 2 is a representative top plan view of the digging tool portion of the backhoe of FIG. 1.
Figure 3:
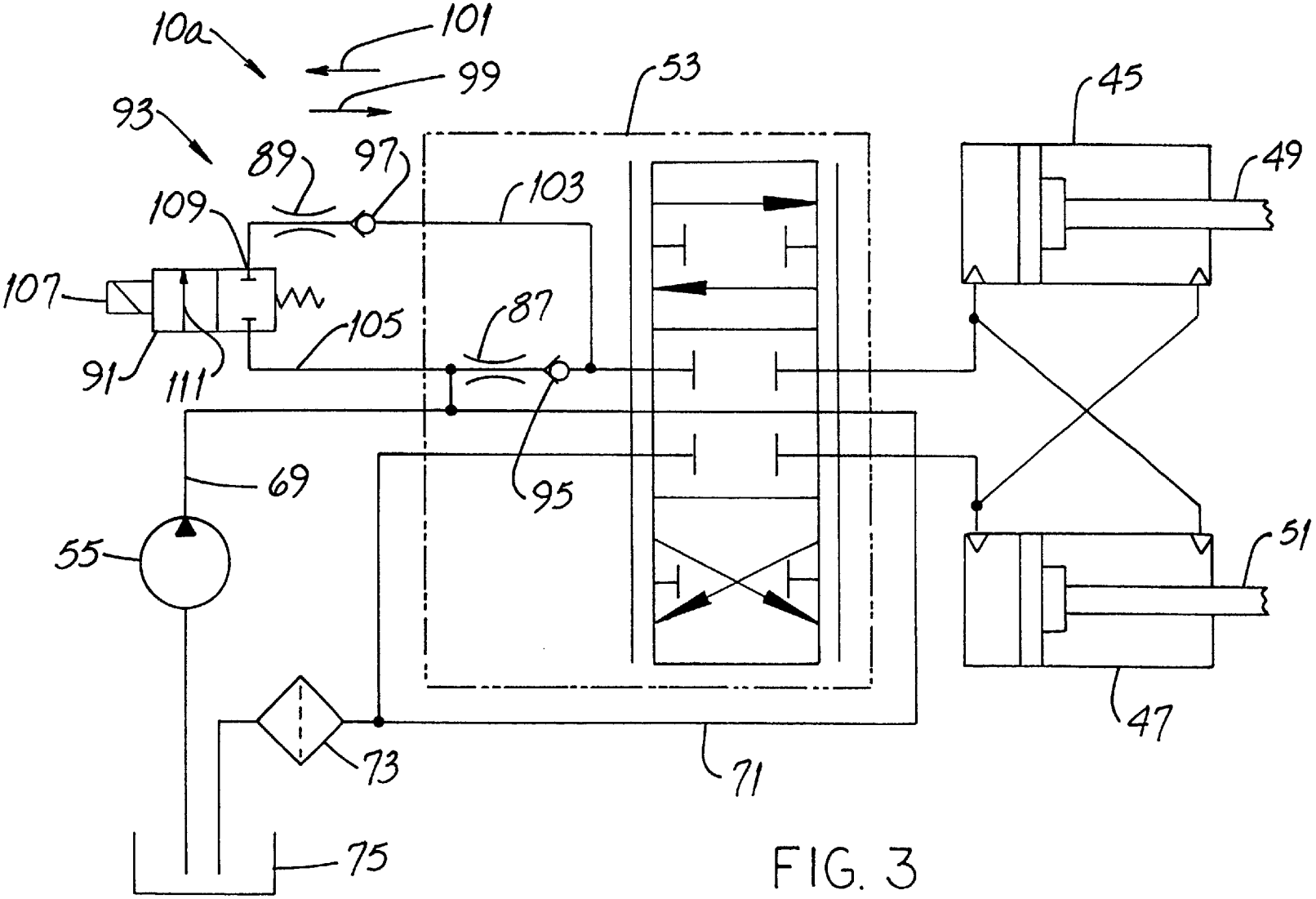
FIG. 3 is an embodiment of an open center version of the inventive circuit.

Before describing the inventive circuits 10 and method, it will be helpful to have an understanding of an exemplary type of construction machine with which such circuit and method can be used. Referring to FIGS. 1, 2 and 3, a backhoe 15 includes a chassis 17 supported on rubber-tired wheels 19. The chassis 17 is configured with an operator's compartment 21 in which are mounted the control levers, pedals, switches and the like that are used to control the backhoe 15. A steering wheel is also in such compartment 21.

The digging tool 23 includes a rigid boom 25 mounted to a rotatable platform 27 by a pivot joint 29. Such joint 29 permits the boom 25 to be pivoted upwardly and downwardly about a horizontal pivot axis 31. One end of a rigid stick 33 is coupled to the boom 25 by another pivot joint 35 which permits the stick 33 to be similarly pivoted about another horizontal axis 37. (The axes 31, 37 are horizontal when the backhoe 15 is resting on a horizontal surface.) A digging bucket 39 is coupled to the other end of the stick 33 by yet a third pivot joint 41 which permits the bucket 39 to pivot (or curl) about the axis 43.

The boom 25, stick 33 and bucket 39 are individually movable by respective hydraulic cylinders coupled to them. Valves for controlling such cylinders are located in the operator's compartment.

In the disclosed embodiment, the platform 27 is rotatable by a pair of hydraulic actuators 45, 47 embodied as linear motors, i.e., cylinders. Such platform rotation is commonly referred to as "swing movement" or simply "swing."

The actuators 45, 47 are cross-connected in push-pull fashion. That is, when rotating the platform 27 (and the boom 25, stick 33 and bucket 39 mounted thereto) in a particular direction, one cylinder rod, e.g., rod 49, retracts and the other rod 51 extends. But an actuator in the form of a rotary hydraulic motor could be used. In either event, the directional valve 53 for swing control is also in the operator's compartment 21.

Open Center Circuits

Referring also to FIGS. 4, 5, 6 and 7 the circuits 10*a*, 10*b* each include a fixed-displacement hydraulic pump 55 coupled to and driven by the backhoe engine. (As a general proposition, a pump of the fixed-displacement type delivers fluid at a flow rate that is a function of the speed at which such pump is driven by the engine. Considered another way, there are no pump controls that can be manipulated to control pump output independently of engine speed.) The directional valve 53 is coupled between the pump 55 and the actuators 45, 47 for controlling extension and retraction and, thus, for controlling the direction of rotation of the platform 27.

Understanding of the circuits 10*a*, 10*b* will be aided by the following. As to the operation of an exemplary actuator, e.g., actuator 45, when fluid is forced into its port 57, the piston head 59 and rod 61 move rightwardly and fluid in the rod chamber 63 is forced outwardly through the port 65. When fluid is forced into the port 65, the piston head 59 and rod 61 move leftwardly and fluid in the head chamber 67 is forced outwardly through the port 57.

Figure 4:
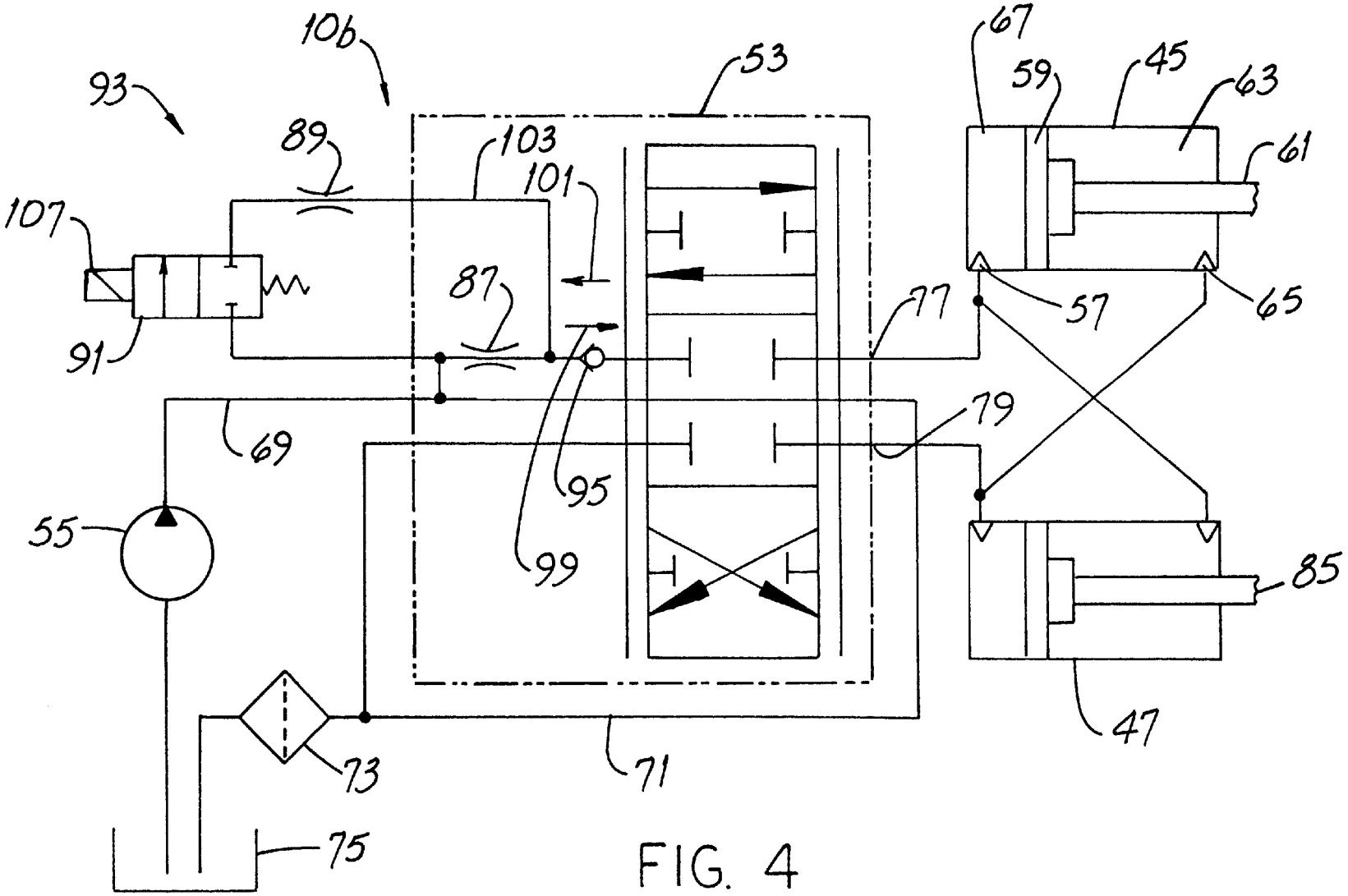
FIG. 4 is another embodiment of an open center version of the inventive circuit.
Figure 5:
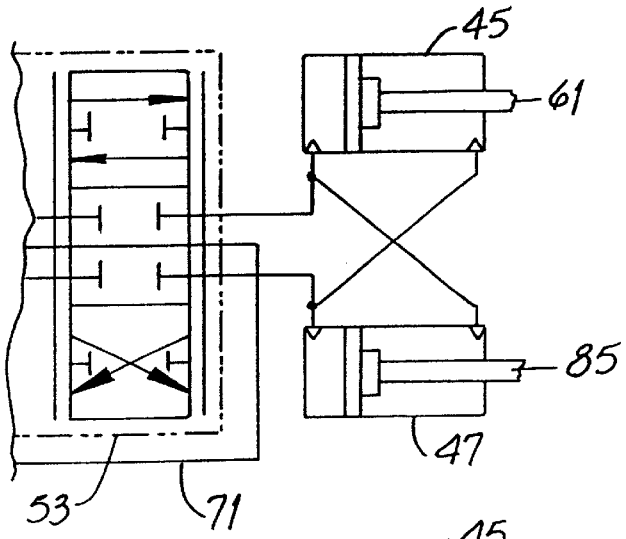
FIG. 5 is a portion of either of the circuits of FIGS. 3 and 4 showing the flow paths in the directional valve and to and from the actuators when the directional valve is in the neutral or "off" position.

FIGS. 3, 4 and 5 show the directional valve 53 in the "neutral" or "off" position. Flow from the pump 55 along the line 69 is through the valve 53 and along the line 71 back through the filter 73 to the reservoir 75. Since the actuator ports 77, 79 are blocked, fluid in both actuators 45, 47 is prevented from leaving such actuators 45, 47 and the actuators 45, 47 (and, therefore, the swing drive) are locked in position.

Figure 6:
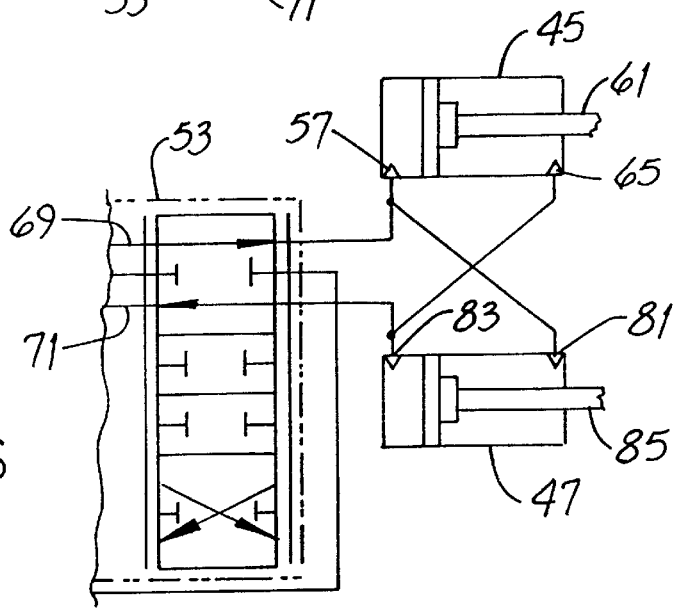
FIG. 6 is a portion of either of the circuits of FIGS. 3 and 4 showing the flow paths in the directional valve and to and from the actuators when the directional valve is shifted for one of two available directions of swinging movement of the digging tool.

FIG. 6 shows the directional valve 53 in a position for a first direction of rotation of the platform 27 and tool 23. Pressurized fluid from the pump 55 flows along the line 69 and is directed to the port 57 of the actuator 45 and to the port 81 of the actuator 47. The ports 65 and 83 are open to the reservoir 75 via the line 71. Therefore, the rod 61 of the actuator 45 extends and the rod 85 of the actuator 47 retracts.

Figure 7:
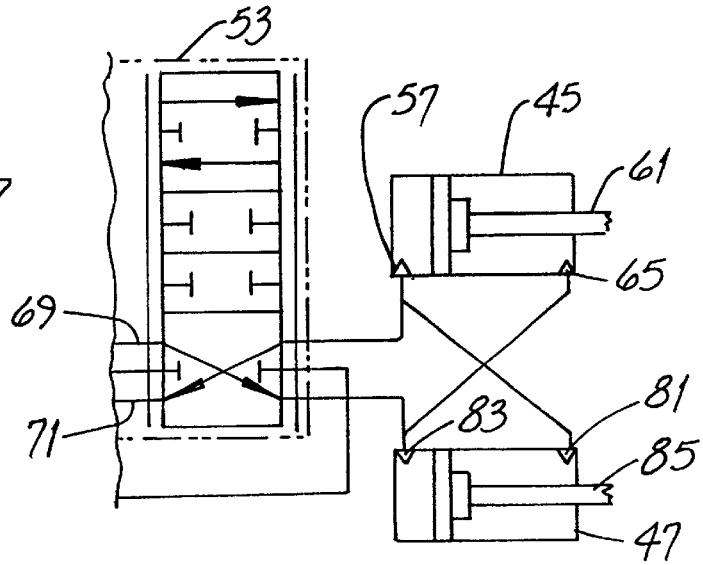
FIG. 7 is a portion of either of the circuits of FIGS. 3 and 4 showing the flow paths in the directional valve and to and from the actuators when the directional valve is shifted for the other of two available directions of swinging movement of the digging tool.

FIG. 7 shows the directional valve 53 in a position for a second direction of rotation of the platform 27 and tool 23.

Pressurized fluid from the pump 55 flows along the line 69 and is directed to the port 65 of the actuator 45 and to the port 83 of the actuator 47. The ports 57 and 81 are open to the reservoir 75 via the line 71. Therefore, the rod 61 of the actuator 45 retracts and the rod 85 of the actuator 47 extends.

(In the circuits of FIGS. 3 through 7, the line 69 is referred to as a power flow path since it is along such line 69 that pressurized fluid flows to power the actuators 45, 47. Similarly, the line 71 is referred to as a return flow path since fluid from the actuators 45, 47 flows along the line 71 to the reservoir 75.)

Referring again to FIGS. 3 and 7, the circuits 10*a*, 10*b* each include first and second flow restrictors 87 and 89, respectively. Such restrictors 87, 89, are coupled between the pump 55 and the actuators 45, 47 and, more specifically, are coupled between the pump 55 and the directional valve 53. Such restrictors 87, 89 are connected in parallel with one another and the restrictor 89, together with the valve device 91, comprises a restrictor circuit 93. The valve device 91 is operable to selectively enable or disable such restrictor 89, i.e., to switch it into or out of the circuit 93.

The circuit 10*b* of FIG. 4 includes a check valve 95 connected to both flow restrictors 87, 89 while the circuit 10*a* of FIG. 3 includes first and second check valves 95, 97 respectively. Such check valves 95, 97 are connected to and in series with the first and second flow restrictors 87, 89, respectively. In either circuit 10*a*, 10*b*, the check valve(s) 95, 97 permit fluid to flow in the direction of the arrow 99 but block such flow in the direction of the arrow 101. In the circuit 10*b* of FIG. 4, one line 103 of the restrictor circuit 93 is connected between the restrictor 87 and the check valve 95. In the circuit 10*a* of FIG. 3, the line 105 of the restrictor circuit 93 is connected between the pump 55 and the restrictor 89.

The valve device 91 may assume one of several possible configurations. In one preferred embodiment, the valve device 91 is a two-position, two-way, normally closed solenoid valve as shown in FIGS. 3 and 4. When the solenoid 107 is de-energized, the port 109 is blocked and the restrictor 89 is disabled. The restrictor circuit 93 may be said to then be in the closed flow state.

But when the solenoid 107 is energized, pump output fluid is permitted to flow along the line 105, through the valve path 111 and along the line 103 through the restrictor 89 and thence to the valve 53. Such restrictor circuit 93 may be said to then be in the open flow state.

Figure 8:
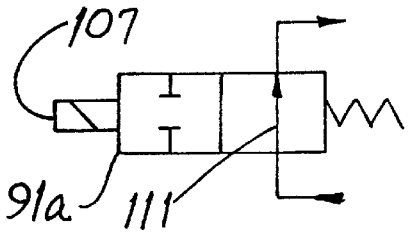
FIGS. 8, 9, 10 and 11 are symbolic representations of other types of valve devices and valve device positions which may be used in place of the valve devices shown in the circuits of FIGS. 3 and 4.
Figure 9:
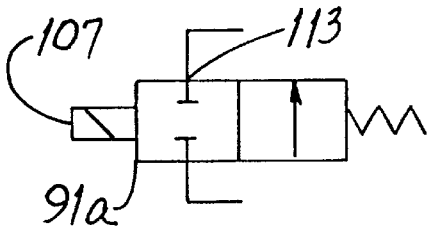

As shown in FIGS. 8 and 9, the valve device 91*a* may also be a normally open solenoid valve. When the solenoid 107 is de-energized as in FIG. 8, fluid is free to flow through the valve path 111 and the restrictor 89 is an active part of the circuit 10*a*, 10*b*. But when the solenoid 107 is energized as in FIG. 9, the port 113 is blocked and the restrictor 89 is disabled. Using a solenoid valve permits such valve to be mounted remotely from the operator's compartment 21 (as is likely to be more convenient from a hydraulic plumbing standpoint) and the valve position controlled by an electric switch or the like.

Figure 10:
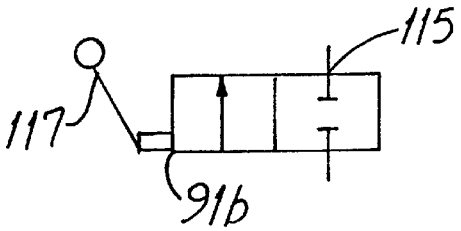
Figure 11:
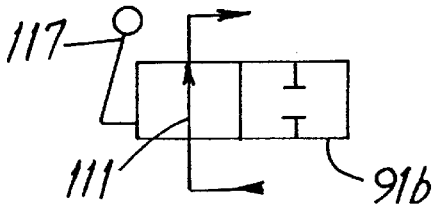

Referring to FIGS. 10 and 11, the valve device 91*b* may also be a two-position, two-way manually operated valve. With the valve device 91*b* in the position shown in FIG. 10, the port 115 is blocked and the restrictor 89 is disabled. But when the valve handle 117 is moved to the position of FIG. 11, pump output fluid is permitted to flow through the valve path 111 and the restrictor 89 and thence to the valve 53.

Referring again to FIGS. 3 and 4, it is to be appreciated that the first flow restrictor 87 is in series with the power flow path (line 69), irrespective of whether the second flow restrictor 89 is disabled. The valve device 91 is configured for movement between a first position (as in FIGS. 8 and 11) and a second position (as in FIGS. 3, 4, 9 and 10) and the second flow restrictor 89 is in series with the power flow path line 69 when the valve device 91 is in the first position. And such second flow restrictor 89 is disconnected from the power path when the valve device 91 is in the second position.

Referring to FIGS. 3 through 11, other aspects of the invention involve a method for controlling swing rate using the open center hydraulic circuits 10*a*, 10*b* having a fixed displacement pump 55. The method includes providing a hydraulic actuator (one actuator 45 or 47 or one of a pair of actuators 45, 47) coupled to the digging tool 23 for tool swinging movement and providing a hydraulic circuit 10*a*, 10*b* as described above. Such restriction circuit 93 has open and closed flow states as described above.

In one mode of operation, fluid is delivered from the pump 55 along the power flow path line 69 to the actuator 45, 47 while the restriction circuit 93 is in the flow-preventing state, thereby obtaining a first, lower swing rate. In another mode of operation, fluid is delivered from the pump 55 along the power flow path line 69 to the actuator 45, 47 while the restriction circuit 93 is in the flow-permitting state, thereby obtaining a second, higher swing rate. As is probably apparent, the second swing rate is higher than the first since there are two paths available through which to flow fluid from the pump 55 to the actuators 45, 47, one each through the restrictor 87 and the restrictor 89.

In more specific aspects of the new method, the power flow path line 69 includes the first flow restrictor 87 in series therewith. Both delivering steps include flowing fluid through the first flow restrictor 87. Where the restriction circuit 93 includes a second flow restrictor 89 in series with a valve device 91, the second delivering step includes delivering fluid from the pump 55 through the second flow restrictor 89.

When the valve device 91 or 91*a* is embodied as a solenoid valve, the method includes the step of opening the solenoid valve (or, depending upon the specific valve configuration, closing such valve). Such opening or closing step occurs after the first delivery step and preceding the second delivery step. When the valve device 91*b* is embodied as a manually operated valve, the method includes the step of opening (or closing) the manually operated valve device 91*b*. As noted above, such opening or closing step occurs after the first delivery step and preceding the second delivery step.

Closed Center Circuits

Before describing those embodiments of the circuit 10*c*, 10*d*, 10*e* which are of the closed center or load-sensing type, i.e., the embodiments shown in FIGS. 12 through 15, it will be helpful to have a general understanding of how such load-sensing systems operate. Irrespective of whether the variable-output power source 121 includes a variable- or fixed-delivery pump, the control arrangement is configured to control output flow from the source so as to maintain a pre-determined differential pressure, e.g., 100 p.s.i to 300 p.s.i (about 7 to 21 kilograms per square centimeter) between the source output port 123 and line 129 (whether connected to line 125 or line 127) to the actuator(s) 45, 47.

Figure 15:
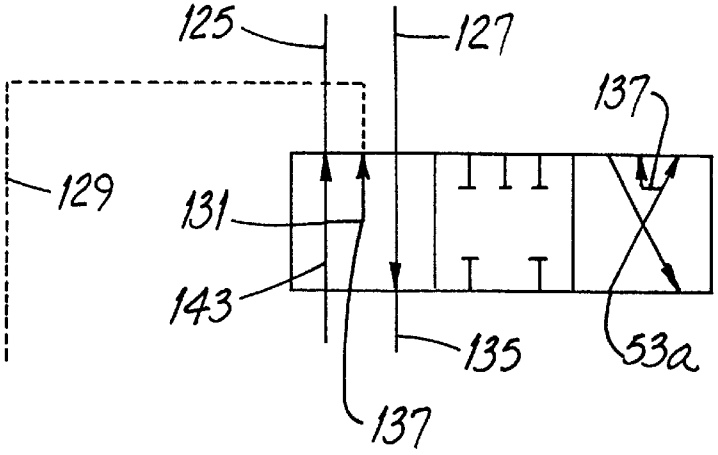
FIG. 15 is a symbolic representation of flow paths and pressure-sensing paths of the directional valve used in the circuits of FIGS. 12, 13 and 14.

It will be appreciated that when the directional valve 53*a* is shifted as shown in FIG. 15 to cause the line 125 to be that line which is pressurized to swing the digging tool 23, the load sensing line 129 "senses" such differential pressure. Those of ordinary skill in the art will recognize that such differential pressure is the pressure "drop" from the port 123 to the junction 131 at which the line 129 is connected to line 125. (It is to be understood that the line 129 and the port 123 are effectively connected to one another inside the power source 121.)

If, for example, the pre-determined differential pressure is 150 p.s.i. (about 10.5 kilograms per square centimeter) and if the swing-motion actuators 45, 47 encounter increased resistance to swinging motion, the pressure at the actuators 45, 47 will increase and, therefore, the actual differential pressure will decrease. Thereupon, the control arrangement causes the power source 121 to deliver more fluid to the port 123 and the supply line 133, thereby causing the actual differential pressure to increase back to the level of the pre-determined or "set point" pressure.

As another example, if the swing-motion actuators 45, 47 encounter less resistance to swinging motion, the pressure at the actuators 45, 47 will decrease and, therefore, the actual differential pressure will increase. Thereupon, the control arrangement causes the power source 121 to deliver less fluid to the supply line 133, thereby causing the actual differential pressure to decrease to the level of the pre-determined or "set point" pressure.

Figure 14:
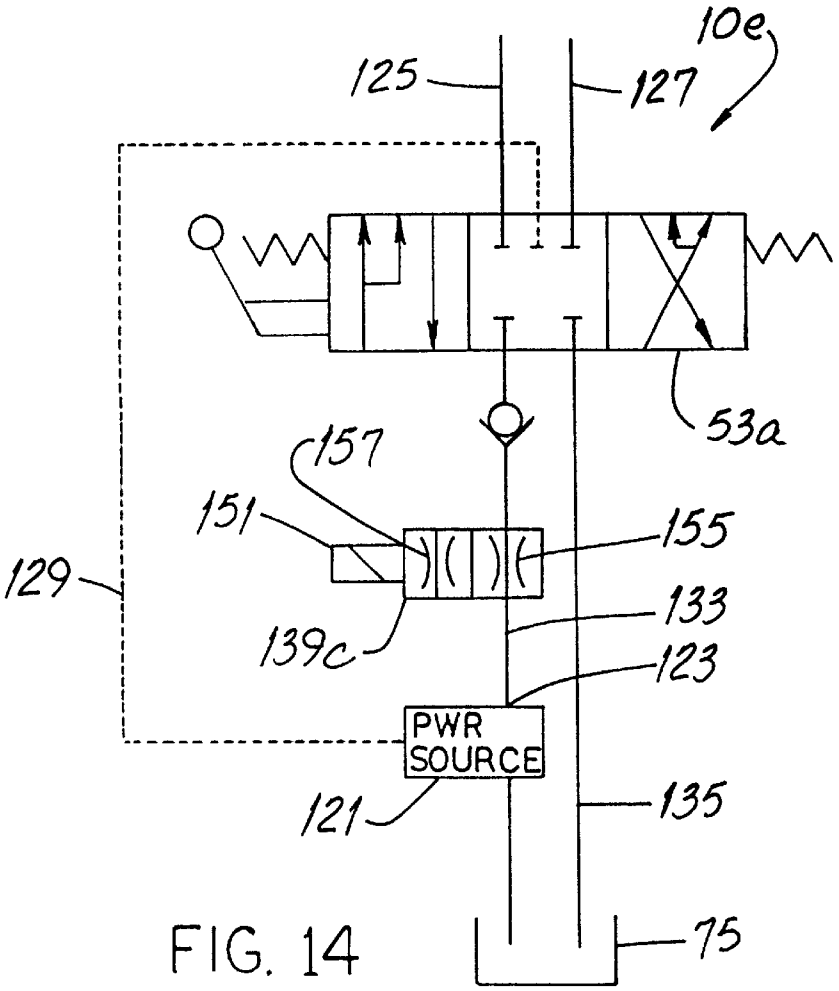
FIG. 14 is an embodiment of yet another closed center version of the inventive circuit.
Figure 12:
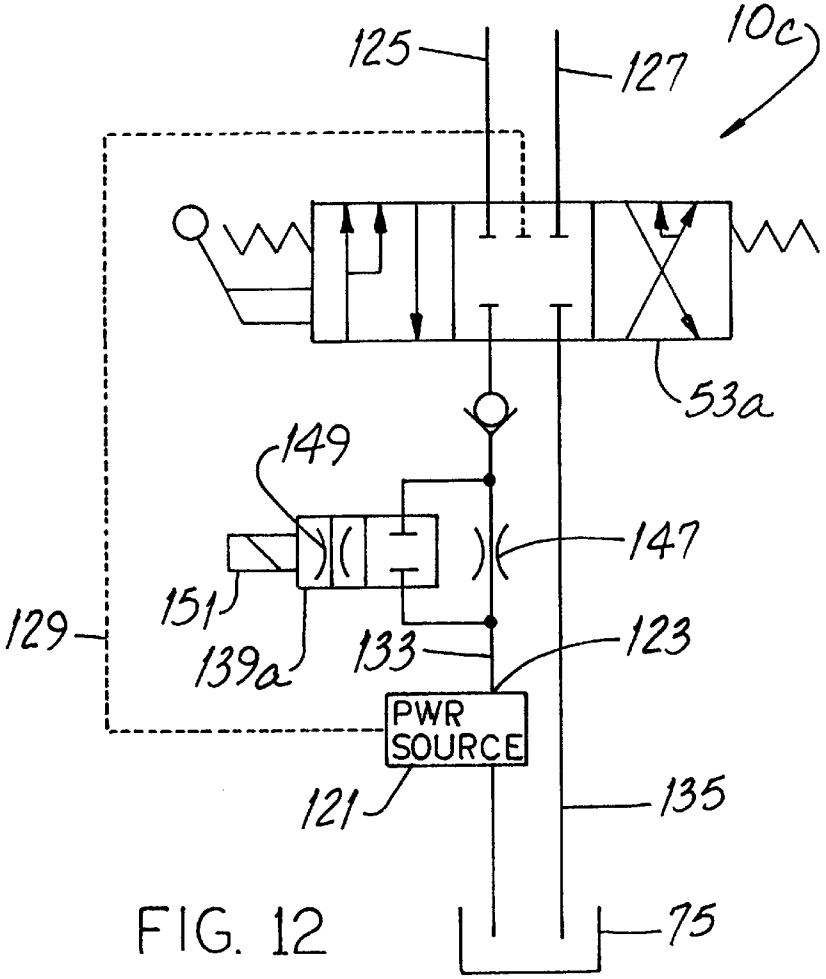
FIG. 12 is an embodiment of a closed center version of the inventive circuit.
Figure 13:
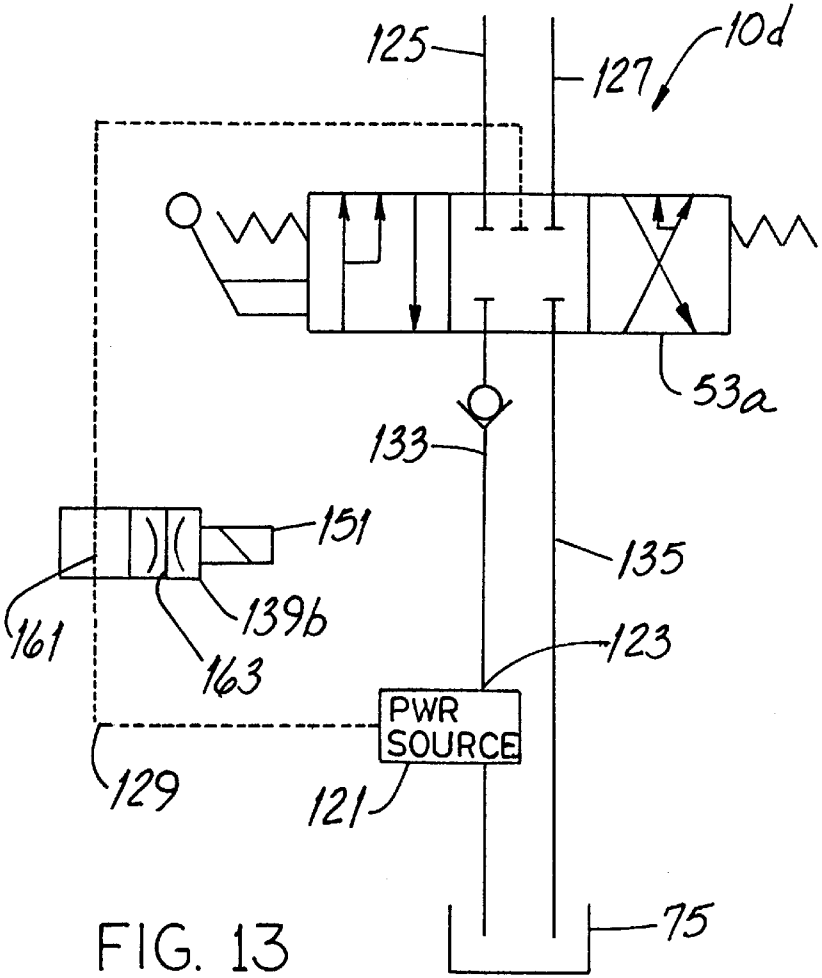
FIG. 13 is an embodiment of another closed center version of the inventive circuit.

As a fundamental proposition common to the circuits 10*c*, 10*d*, 10*e* shown in FIGS. 12, 13 and 14 (and perhaps ascribing some human attributes to such circuits) the novel circuits 10*c*, 10*d*, 10*e* are configured in such a way as to "fool" the control arrangement in the power source 121. This causes the power source 121 to deliver an output flow different from that which otherwise would have been delivered. And, of course, if the flow rate from the power source 121 is reduced or increased, the maximum rate at which the digging tool 23 swings will also be reduced or increased from the rate which otherwise would have occurred.

To be somewhat more specific, the circuits 10*c*, 10*e* shown in FIGS. 12 and 14, are capable of selectively changing the resistance to flow by inserting a flow restrictor in the power flow path of line 133. In that way, the total pressure differential being sensed by the line 129 occurs, in part, across the flow restrictor rather than entirely between the pump output port 123 and the actuator line 125 or 127, as the case may be. Output flow from the power source 121—and, therefore, the rate of swinging motion—is thereby reduced. It is fair to say that a flow restrictor in the power flow path of line 133 causes the actual differential pressure between the port 123 and the line 125 or 127 to appear artificially high and source output flow is reduced to compensate therefor.

(As further described below, the circuit 10*c* of FIG. 12 changes flow resistance by selectively inserting a second flow restrictor in parallel with a flow restrictor permanently connected in the line 133. The circuit 10*e* of FIG. 14 changes flow resistance by selectively inserting either of two different flow restrictors in the line 133.

The circuit 10d shown in FIG. 13 is capable of selectively inserting a flow restrictor in the load-sensing line 129. Because such flow restrictor will cause a pressure drop (i.e., a loss) thereacross, the restrictor causes the actual differential pressure between the pump output port 123 and the actuator line 125 or 127 to appear artificially low. As a result, the source output flow is increased to compensate therefor. To put it another way, when the flow restrictor is in series with the load-sensing line 129, the swing rate will be higher than when the unrestricted valve device path is in series with such line 129.

Each of the circuits shown in FIGS. 12, 13 and 14, has a reservoir 75 and a variable-output power source 121 drawing fluid from the reservoir 75 and powering the actuators 45, 47. Such power source 121 may be configured as a pressure-controlled variable-delivery pump (i.e., a pump of the type commonly known as a "PV" pump). Or such power source 121 may be configured as a fixed delivery pump (a "PF" pump, the output of such is a function of pump rotational speed) fitted with a load-sensing unloading valve. The unloading valve is pressure-positioned to "unload" or bypass part of the pump output flow back to the reservoir 75 rather than permitting such part to flow along the power path of line 133 to the actuators 45, 47. (PV pumps and PF pumps with unloading valves are, per se, known.)

Each of the circuits also 10*c*, 10*d*, 10*e* includes a directional valve 53*a* connected between the power source 121 and the actuators 45, 47. Line 133 is a "supply line" or power flow path extending from the power source 121 to the actuators 45, 47 and a return flow path line 135 extends from the actuators 45, 47 through the valve 53*a* to the reservoir 75. A load-sensing line 129 is coupled between the power source 121 and the actuators 45, 47 for sensing the differential pressure therebetween. That is, the load-sensing line 129 "communicates" the pressure differential between the power source 121 and the actuators 45, 47 to the control arrangement of the PV or the PF pump described above.

Considering FIG. 15, the load-sensing line 129 "picks up" the pressure at the actuator by virtue of one of two sensing paths 137 in the directional valve 53*a*. When the valve 53*a* is shifted in one direction or the other, a path 137 is hydraulically connected to both the actuators 45, 47 and to the load-sensing line 129. (Since the pressure drop along a line 125, 127 between the valve 53*a* and the actuators 45, 47 is relatively small, it is assumed that the pressure in a line 125, 127 and the pressure at the actuators 45, 47 are substantially equal to one another.)

A valve device 139*a*, 139*b* or 139*c* is provided and is coupled in flow-affecting relationship in the circuit 10*c*, 10*d*, 10*e*. Such valve device 139*a*, 139*b* or 139*c* is configured for movement between first and second positions. Fluid is delivered from the power source 121 along the power flow path of line 133 to the actuators 45, 47 while the device 139*a*, 139*b* or 139*c* is in the first position, thereby obtaining a first swing rate. And fluid is delivered from the source 121 along the power flow path of line 133 to the actuators 45, 47 while the device 139*a*, 139*b* or 139*c* is in the second position, thereby obtaining a second swing rate.

When the directional valve 53*a* is shifted for swinging the implement or digging tool 23 in one direction or the other, the line 129 is also coupled between the source 121 and the actuators 45, 47. For example, when the valve is shifted as shown in FIG. 15, the power source 121 is in flow communication with the actuators 45, 47, through the valve path 143.

Considering FIG. 12, the first flow restrictor 147 is permanently connected in series with the power flow path of line 133. The valve device 139*a*, an exemplary two-position, two way solenoid valve, is in the position shown and flow through the device 139*a* is blocked. In such position, the second flow restrictor 149 is not connected in the circuit 10*c*.

When the solenoid 151 is energized, the device 139*a* shifts rightwardly and "inserts" the second flow restrictor 149 in parallel with the first restrictor 147. Irrespective of the degree of restriction presented by either of the restrictors 147, 149 the degree of restriction presented by both restrictors 147, 149 in parallel will be less and the tool 23 may be swung more rapidly that when only the restrictor 147 is in the circuit 10*c*.

Referring next to FIG. 14, the valve device 139*c*, also an exemplary two-position, two way solenoid valve, has a first position (as in FIG. 14) in which a first flow restrictor 155 is in the power flow path of line 133. When the solenoid 151 is energized, the device 139*c* shifts rightwardly and inserts the second flow restrictor 157 in the flow path in place of the first restrictor. The restrictors 155, 157, are assumed to have differing degrees of restriction so that each position of the device 139*c* results in a different rate of tool movement.

Referring now to FIG. 13, a valve device 139*b* is in series with the load-sensing line 129. Such valve device 139*b* includes a restriction-free path 161 and a flow-restricted path 163 therethrough, thereby configuring the circuit 10*d* to provide either of two maximum rates of tool swing movement. That is, when the device 139*b* is in the position shown in FIG. 13, the restriction-free path 161 is in series with the load-sensing line 129. And when the solenoid 151 is energized and the device 139*b* is shifted leftwardly, the flow-restricted path 163 is in series with the line 129.

Considering the circuits shown in FIGS. 12 through 15, a method for controlling the maximum swing rate of a digging tool 23 mounted for swing movement on a chassis 17 of a construction machine (e.g., backhoe 15) includes providing a hydraulic actuators 45, 47 for swinging the digging tool 23 and providing a hydraulic circuit 10*c*, 10*d* or 10*e* including a reservoir 75, a variable-output hydraulic power source 121 connected to the reservoir 75 and powering the actuators 45, 47 and a directional valve 53*a* connected between the power source 121 and the actuators 45, 47. The circuit 10*c*, 10*d* or 10*e* has a power flow path line 133, from the source 121 to the actuators 45, 47 and a return flow path line 135, from the actuators 45, 47 to the reservoir 75. The circuit 10*c*, 10*d*, 10*e* also includes a load-sensing line 129 coupled between the power source 121 and the actuators 45, 47.

A valve device 139*a*, 139*b* or 139*c* is provided to be coupled in flow-affecting relationship in the circuit 10*c*, 10*d* or 10*e*. Such device 139*a*, 139*b*, 139*c* is configured for movement between first and second positions.

While the device 139*a*, 139*b*, 139*c* is in the first position, fluid is delivered from the power source 121 along the power flow path line 133 to the actuators 45, 47 thereby obtaining a first swing rate. And while the device 139*a*, 139*b* or 139*c* is in the second position, fluid is delivered from the power source 121 along the power flow path line 133 to the actuators 45, 47 thereby obtaining a second swing rate.

Considering the circuits of FIGS. 12 and 14, the valve device 139*a* or 139*c* is connected to the power flow path 121 and, following the first delivering step and preceding the second delivering step, the method includes the step of shifting the valve device 139*a* or 139*c* from the first position to the second position. And considering the circuit of FIG. 13, the valve device 139*b* is connected to the load-sensing line 129. Following the first delivering step and preceding the second delivering step, the method includes the step of shifting the valve device 139*b* from the first position to the second position.

While the principles of the invention have been shown and described in connection with preferred embodiments, it is to be understood clearly that such embodiments are by way of example and are not limiting.

What is claimed:

1. In a hydraulic circuit for a construction machine having a chassis and a digging tool mounted for movement with respect to the chassis, the circuit including a pump, a hydraulic actuator coupled to the tool for tool movement, and a directional valve coupled between the pump and the actuator, the circuit improvement comprising:

first and second flow restrictors coupled between the pump and the actuator; and a valve device for selectively disabling the second flow restrictor, thereby configuring the circuit to provide either of two maximum rates of tool movement.

2. The circuit of claim 1 wherein the first and second flow restrictors are connected in parallel with one another.

3. The circuit of claim 2 wherein:

the first and second flow restrictors are coupled between the pump and the directional valve; and the circuit includes a check valve connected to the first and second flow restrictors.

4. The circuit of claim 2 wherein:

the first and second flow restrictors are coupled between the pump and the directional valve; and the circuit includes first and second check valves connected to the first and second flow restrictors, respectively.

5. The circuit of claim 4 wherein the first and second check valves are connected in series with the first and second flow restrictors, respectively.

6. The circuit of claim 1 wherein the valve device is a two-position, two-way solenoid valve.

7. The circuit of claim 1 wherein the valve device is a two-position, two-way manually operated valve.

8. The circuit of claim 1 further including a reservoir and wherein:

the directional valve includes a power flow path from the pump to the actuator and a return flow path from the actuator to the reservoir; and the first flow restrictor is in the power flow path, irrespective of whether the second flow restrictor is disabled.

9. The circuit of claim 8 wherein:

the valve device is configured for movement between a first position and a second position; and the second flow restrictor is in the power flow path when the valve device is in the first position.

10. The circuit of claim 9 wherein:

the second flow restrictor is disconnected from the power path when the valve device is in the second position.

11. In a hydraulic circuit for a construction machine having a chassis and a digging tool mounted for movement with respect to the chassis, the circuit including a variable-delivery hydraulic power source, a hydraulic actuator coupled to the tool for tool movement, and a directional valve coupled between the power source and the actuator, and wherein the power source and the hydraulic actuator have a differential pressure therebetween, the improvement wherein:

the circuit includes a load-sensing line coupled between the power source and the actuator, thereby sensing the differential pressure;

a valve device is connected in the circuit and is configured for movement between first and second pressure-drop positions, thereby configuring the circuit to provide either of two maximum rates of tool movement.

12. The circuit of claim 11 including a supply line from the power source to the actuator and wherein the valve device is connected to the supply line.

13. The circuit of claim 11 wherein the valve device is connected to the load-sensing line.

14. A method for controlling the maximum swing rate of a digging tool mounted for swing movement on a chassis of a construction machine, the method including:

providing a hydraulic actuator coupled to the digging tool for swinging movement thereof;

providing a hydraulic circuit including (a) a reservoir, (b) a pump connected to the reservoir and powering the actuator, (c) a directional valve connected between the pump and the actuator and including a power flow path from the pump to the actuator and a return flow path from the actuator to the reservoir, (d) a first flow restrictor in the power flow path, and (e) a restriction circuit connected in parallel with the power flow path and having closed and open flow states;

delivering fluid from the pump along the power flow path to the actuator while the restriction circuit is in the closed state, thereby obtaining a first swing rate; and delivering fluid from the pump along the power flow path to the actuator while the restriction circuit is in the open state, thereby obtaining a second swing rate.

15. The method of claim 14 wherein the power flow path includes a first flow restrictor in series therewith and wherein:

both delivering steps include flowing fluid through the first flow restrictor.

16. The method of claim 15 wherein the restriction circuit includes a second flow restrictor in series with a valve device and wherein:

the second delivering step includes delivering fluid from the pump through the second flow restrictor.

17. The method of claim 16 wherein the valve device is a solenoid valve having open and closed states and, following the first delivery step and preceding the second delivery step, the method includes the step of:

changing the state of the solenoid valve.

18. The method of claim 16 wherein the valve device is a manually operated valve having open and closed states and, following the first delivery step and preceding the second delivery step, the method includes the step of:

changing the state of the manually operated valve.

19. A method for controlling the maximum swing rate of a digging tool mounted for swing movement on a chassis of a construction machine, the method including:

providing a hydraulic actuator for swinging the digging tool;

providing a hydraulic circuit including (a) a reservoir, (b) a variable-output hydraulic power source connected to the reservoir and powering the actuator, (c) a directional valve connected between the power source and the actuator and including a power flow path from the pump to the actuator and a return flow path from the actuator to the reservoir, and (d) a load-sensing line coupled between the pump and the actuator;

providing a valve device coupled in flow-affecting relationship in the circuit, such valve device being configured for movement between first and second positions;

delivering fluid from the pump along the power flow path to the actuator while the device is in the first position, thereby obtaining a first swing rate; and delivering fluid from the pump along the power flow path to the actuator while the device is in the second position, thereby obtaining a second swing rate.

20. The method of claim 19 wherein the valve device is connected to the power flow path and, following the first delivering step and preceding the second delivering step, the method includes the step of shifting the valve device from the first position to the second position.

21. The method of claim 19 wherein the valve device is connected to the load-sensing line and, following the first delivering step and preceding the second delivering step, the method includes the step of shifting the valve device from the first position to the second position.

* * * * *